United States Patent [19]

Proehl

[11] Patent Number: 4,593,484

[45] Date of Patent: Jun. 10, 1986

[54] METHOD OF DREDGING WITH A PIVOTALLY MOUNTED CUTTER HEAD

[76] Inventor: Norman P. Proehl, 373 E. Westminster Ave., Lake Forest, Ill. 60045

[21] Appl. No.: 701,774

[22] Filed: Feb. 14, 1985

[51] Int. Cl.[4] ..... E02F 3/92

[52] U.S. Cl. ..... 37/195; 37/67

[58] Field of Search ..... 37/67, 65, 64, 195

[56] References Cited

U.S. PATENT DOCUMENTS

| | | | |
|---|---|---|---|
| 265,500 | 10/1882 | Herron . | |
| 388,253 | 8/1888 | Bowers | 37/65 |
| 2,242,520 | 5/1941 | Grundborg | 37/67 |
| 3,171,219 | 3/1965 | Kaufmann et al. | 37/56 |
| 3,253,357 | 5/1966 | Allard | 37/65 |
| 3,495,409 | 2/1970 | Riedemann | 61/3 |
| 4,163,330 | 8/1979 | Konijn | 37/64 |

FOREIGN PATENT DOCUMENTS

| | | | |
|---|---|---|---|
| 1484761 | 4/1969 | Fed. Rep. of Germany . | |
| 298911 | 10/1963 | Netherlands . | |
| 2065751 | 7/1981 | United Kingdom | 37/64 |

*Primary Examiner*—Clifford D. Crowder

*Attorney, Agent, or Firm*—Kinzer, Plyer, Dorn & McEachran

[57] ABSTRACT

A method and apparatus for efficiently and economically hydraulically dredging to a level bottom. The method includes the use of a cutter head which is pivotally mounted to the end of a dredging ladder. The cutter head is swung through its cutting arcs with the axis of rotation of the cutter head aligned with the longitudinal axis of the ladder. The cutter head is tilted relative to the longitudinal axis of the ladder until the cutter blades are parallel to the level bottom to be cut with the adjustment accomplished before the cutter head is swung through the last cutting arc above the level bottom to be reached. The apparatus includes a pivotal connection between the cutter head and the ladder which is located at the trailing edges of the cutter blades so as to follow the path of the trailing edge of the swath of the normal cut of the cutter head.

1 Claim, 5 Drawing Figures

METHOD OF DREDGING WITH A PIVOTALLY MOUNTED CUTTER HEAD

BACKGROUND AND SUMMARY OF THE INVENTION

This invention is directed to a hydraulic dredge cutter head which is mounted on a dredge ladder in a novel manner and to a method of using this uniquely mounted cutter head to dredge in a most efficient and productive manner.

Cutter heads which are pivotally mounted on the end of a dredge ladder are known in the art, a good example of which is the cutter head shown in Netherlands Patent No. 298,911 to Glas. In the prior art, such cutter heads are mounted on stub arms which are pivotally attached to the end of a dredge ladder. Because of the length of such a stub arm, even a small angular rotation of the cutter head causes a relatively large movement of the cutter head along an arcuate path. This arcuate movement reduces the efficiency of production of such a cutter head because every time the cutter head is pivoted relative to the end of the ladder, either to maintain the cutter head horizontally, as suggested by some of the prior art, or to cut to a level bottom, as suggested by other of the prior art, the effective arc of the ladder and cutter head is shortened and the cutter head is backed out of the swath which is being cut. In this manner, the amount of material removed during a subsequent arcuate swing of the ladder and cutter head is reduced.

The most efficient digging swath is maintained when the cutter head is a longitudinal extension of the ladder because this arrangement provides the widest digging swath for the cutting head and thus the greatest removal of material during a cutting arc. However, it is desirable at times to dig to a flat bottom without the additional expense and time of overdigging and this is best accomplished by using a pivotally mounted cutter head. Using the novel mounting of the cutter head of my invention, it is possible to tilt the cutter head to a level bottom cutting position without reducing the effective cutting swath of the fully extended cutter head.

Consequently, a purpose of this invention is to provide a tiltable cutter head for a hydraulic dredge which cutter head moves only a small arcuate distance when it is tilted through a relatively large angle relative to the dredge ladder.

Another purpose of this invention is to provide a rotatable cutter head for a hydraulic dredge which is tiltably mounted on the end of a ladder in such a manner that the cutter head is not pulled out of the normal cutting swath of the cutter head when it is tilted from its aligned position with the ladder.

Another purpose of this invention is a pivotable mounting for a cutter head which allows the cutter head to be pivoted from alignment with the longitudinal axis of a ladder to a level bottom digging position without reducing the effective cutting swath of the cutter head.

Another purpose of this invention is a method of dredging to a level flat bottom using a tiltable cutter head in which the cutter head is maintained aligned with the longitudinal axis of the ladder during all of the cutting arcs through a bank of material except the last cutting arc above the bottom of the bank of material at which point it is tilted so its blades are parallel to the desired level bottom.

BRIEF DESCRIPTION OF THE DRAWINGS

The invention is illustrated more or less diagrammatically in the following drawings wherein.

DESCRIPTION OF THE PREFERRED EMBODIMENT

Figures 1, 2:
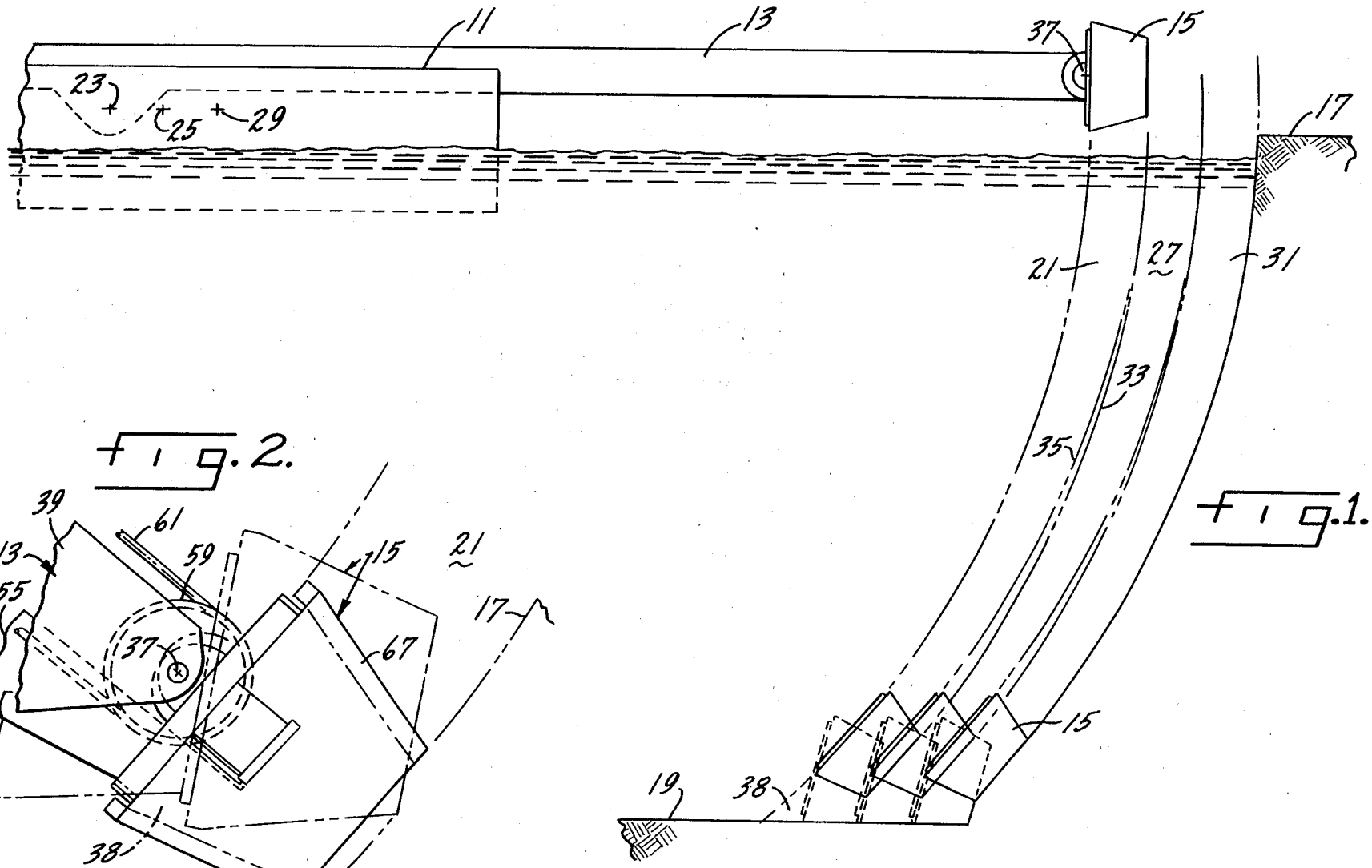
FIG. 1 is a partial side elevational view of a dredging apparatus embodying the novel features of this invention with the cutter head shown in various positions as it is digging through a bank of material to be dredged with the tilted positions of the cutter head shown in phantom line.
FIG. 2 is a partial, enlarged elevational view of the ladder and cutter head showing the cutter head in solid lines in its normal position of dredging and in phantom lines when it is tilted to its level bottom digging position.

FIG. 1 of the drawings shows a floating dredge barge 11 on which is mounted a ladder 13 which can be lowered from the horizontal position shown in the drawings while the barge and ladder are swung back and forth in arcs to move the cutter head 15 through a bank 17 of material to be dredged to dig to a level bottom 19. In digging material from the embankment, the ladder 13 swings in a number of horizontal arcs as the barge is pivoted about a digging spud, which is not shown in the drawings but is well known in the art. After each digging arc, the ladder 13 and cutrer head 15 are lowered to the next digging level and another digging arc is made. The series of digging arcs form a vertical swath in the embankment. The first vertical swath 21 is created when the horizontal pivotal axis of the ladder 13 is located at point 23. After the completion of digging of the swath 21, the barge is moved forward so that the horizontal pivotal axis of the ladder 13 is located at point 25 from which vertical swath 27 is dug. After completion of digging of the vertical swath 27, the barge is moved forward so that the horizontal pivotal axis of the ladder 13 is located at point 29 at which time the next swath 31 is dug. It should be noted that the swaths are not of uniform horizontal width from top to bottom. For example, the forward edge of swath 21 which is designated by line 33 is overlapped by the rearward edge of swath 27 designated by the line 35. This overlap occurs because the swaths are not being cut from a common center pivotal axis but from linearly sepaparated pivot axes 23, 25 and 29. It should also be noted that it is not possible to cut to a flat bottom at the particular depth shown in the drawings with the cutter head illustrated because the angle of inclination of the blades of the cutter head is not the same as the angle of the ladder relative to the horizontal at the time the ladder is lowered to the desired depth of the cut. Therefore, it is necessary to rotate the cutter head relative to the ladder about its pivotal connection until the blades of the cutter head are parallel to the desired bottom 19.

In one aspect of my invention, I have found that the most efficient production is obtained by not tilting the cutter head 15 to its level bottom cutting position until the cutter head is in the arc just above the final cutting arc as shown in FIG. 1 of the drawings. At this point, the cutter head is rotated from its position in which its axis of rotation is aligned with the longitudinal axis of the cutter head to a position in which its blades will cut a level bottom 19 which position is shown in phantom line in FIG. 1. Tilting of the cutter head will not reduce the width of a cutting swath such as swath 21 although the efficiency of the cutter head will be reduced somewhat because the leading edges of the cutter blades will dig slightly into the embankment 17 beyond the desired swath and the trailing edges of the blades will not cut a small triangular piece 38 of the swath as shown in FIGS. 1 and 2. This small triangular piece 38 of the bank will be left during the cutting of the first swath 21 but will be removed by the tilted cutter head when cutting to the bottom of subsequent swaths as shown in FIG. 1 of the drawings. This is one of the advantages of not tilting the cutter head from its normal cutting position relative to the ladder until completion of digging of the arc above the last arc needed to dig to the required depth 19.

The location of the pivotal connection 37 between the cutter head 15 and the ladder 13 is one of the novel aspects of my invention. In previous tiltable mounting cutting heads, the cutting head was mounted on a stub arm which was pivotally connected to the end of the ladder, thus placing the cutrer head a considerable distance from the point of pivot. In such a construction, even a small angular tilting of the cutting head moves the cutting head a considerable arcuate distance. Thus, whenever the cutter head was tilted, it was moved out of the normal cutting swath that the cutter head had created when it was positioned as a longitudinal extension of the ladder. Such tilting reduced the amount of material cut by the cutter head during subsequent arcs. The effect of tilting is shown most clearly in FIG. 2 of the drawings. It is readily apparent that because of the close proximity of the pivotal connection 37 to the rear of the cutter head 15, even a large angular tilting of the cutter head does not pull it a significant amount out of a normal cutting swath 21. In effect, the pivotal connection 37 follows the trailing edge of a swath such as that indicated by line 35 for swath 27. Thus, with the location of the pivotal mounting of this connection, the cutting efficiency of the cutter head is not reduced significantly when it is tilted relative to the ladder.

Figure 3:
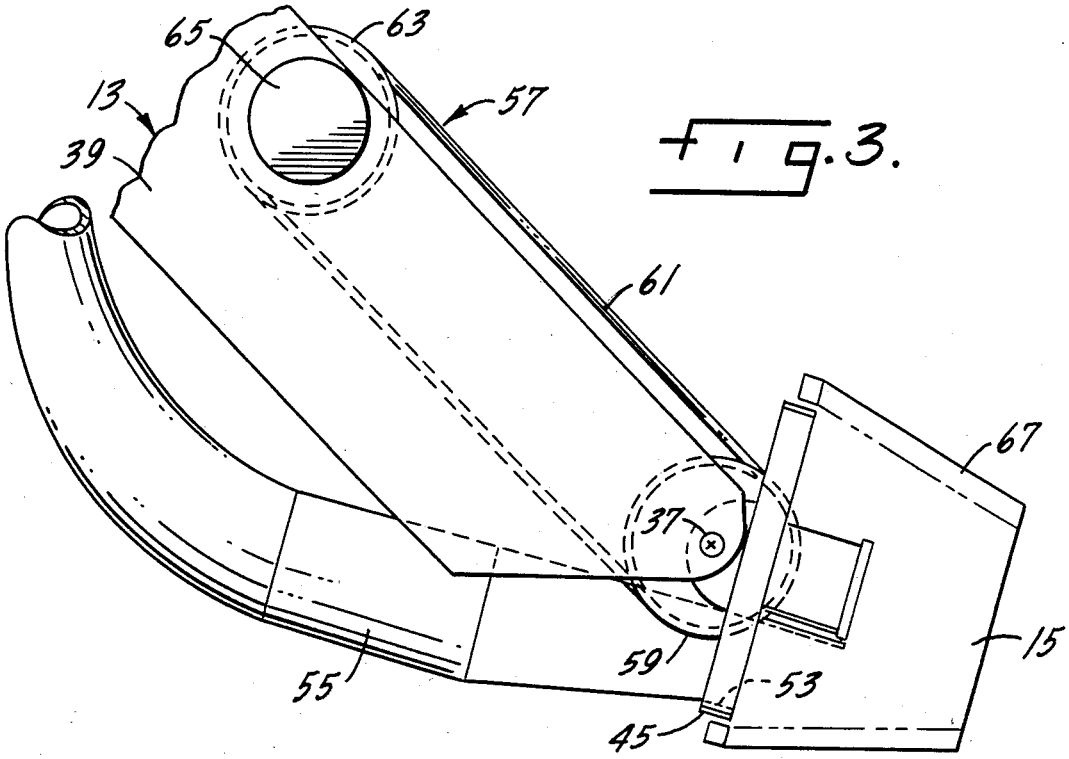
FIG. 3 is a partial, enlarged side elevational view showing the cutter head pivotally mounted on the end of the dredge ladder.
Figure 4:
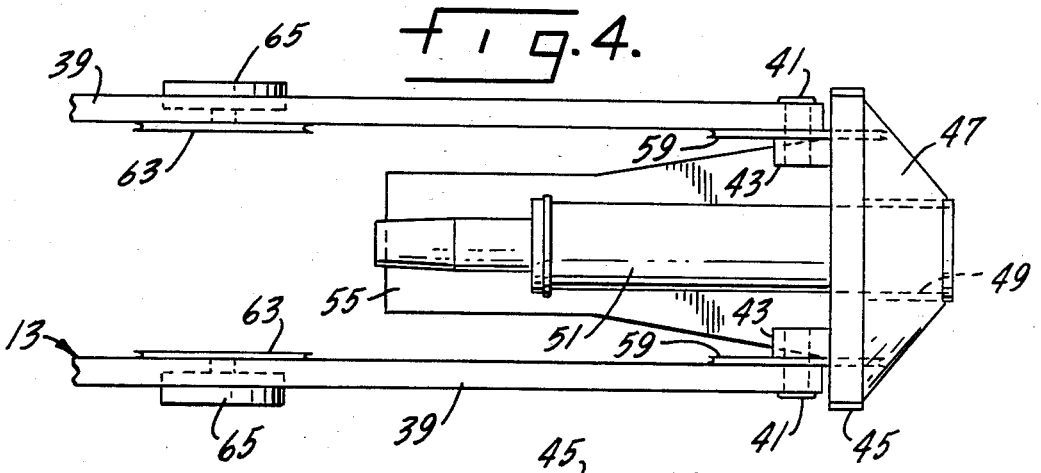
FIG. 4 is a partial, enlarged plan view of the dredge ladder showing the mounting for the cutter head with parts eliminated for clarity of illustration.
Figure 5:
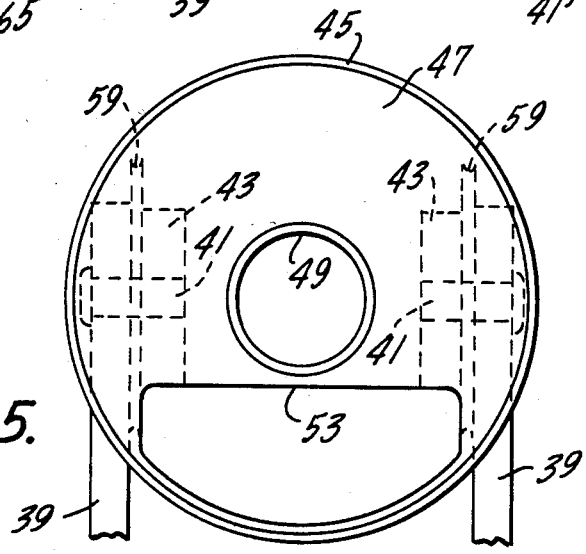
FIG. 5 is a partial, enlarged front elevational view of the apparatus of FIG. 4.

The details of the pivotal connection 37 of the cutter head 15 to the ladder 13 are shown in FIGS. 3 through 5 of the drawings. The ladder 13 has side beams 39. Pivot pins 41 extending through the ends of the side beams are journalled in brackets 43 attached to the cutter head back ring 45. A frusto-conical hub 47 extends forwardly of the back ring 45. A circular opening 49 is formed in the hub and this opening receives the cutter head drive shaft 51. A suction pipe opening 53 is also formed in the cutter head hub 47 and the suction pipe 55 shown in FIG. 3 is connected to this opening.

The cutter head 15 is tilted relative to the ladder 13 by means of a mechanism 57. As part of this mechanism, a grooved sheave 59 is journalled on each pivot pin 41 connected to the cutter head hub 47. Drive cables 61 shown in FIG. 3 of the drawings connect each of these sheaves to drive sheave 63 located a distance up the ladder. Each one of the drive sheaves 63 is driven by a hydraulic motor 65.

The cutter head 15, which may be of the type shown in my U.S. Pat. No. 4,050,170, is equipped with cutter blades 67 which converge relative to the axis of rotation of the cutter head from their trailing edges to their leading edges. However, it should be understood and appreciated that other frusto-conical cutter heads as well as other types of cuttter heads may be used in practicing my invention.

I claim:

1. A method of hydraulic dredging to a smooth level bottom using a ladder having a rotating frusto-conical cutter head pivotally mounted on the end of the ladder in which the cutter head has blades which converge relative to the axis of rotation of the cutter head from the trailing edges to the leading edges thereof, including the steps of:

positioning the pivotal connection between the ladder and the cutter head immediately rearwardly of the trailing edges of the cutter head cutting blades, swinging the rotating cutter head in a series of arcs to the material to be dredged, starting at the top of the material and working downwardly towards the bottom of the material with the cutter head oriented on the ladder so that the axis of rotation of the cutter head is generally aligned coaxially with the longitudinal axis of the ladder, and tilting the cutter head relative to the longitudinal axis of the ladder until the cutter blades positioned at the bottom of the cutter head are parallel to the level bottom to be cut with this adjustment taking place after completion of digging of the cutting arc above the last cutting arc needed to dig to the required depth and before the cutter head is swung through said last cutting arc.

* * * * *